US006431537B1

(12) United States Patent
Meier

(10) Patent No.: US 6,431,537 B1
(45) Date of Patent: Aug. 13, 2002

(54) MULTIPLE CARD HOPPER FOR CARD PRINTER

(75) Inventor: James R. Meier, St. Paul, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/604,642

(22) Filed: Jun. 27, 2000

(51) Int. Cl.[7] ..... B65H 3/44

(52) U.S. Cl. ..... 271/9.01; 271/9.05; 271/9.08; 271/9.12

(58) Field of Search ..... 271/9.01, 9.05, 271/9.06, 9.08, 9.07, 9.12, 162

(56) References Cited

U.S. PATENT DOCUMENTS

| | | | | |
|---|---|---|---|---|
| 4,872,660 A | | 10/1989 | Kameyama et al. | 271/9.02 |
| 5,076,562 A | * | 12/1991 | Sai et al. | |
| 5,145,160 A | | 9/1992 | Nagashima et al. | 271/9.09 |
| 5,156,385 A | | 10/1992 | Muto et al. | 271/3.2 |
| 5,299,796 A | | 4/1994 | Wooldridge | 271/9 |

FOREIGN PATENT DOCUMENTS

| | | | |
|---|---|---|---|
| JP | 3-223038 | * 10/1991 | 271/9.08 |
| JP | 3-223039 | * 10/1991 | 271/9.08 |
| JP | 2000-226126 A | 8/2000 | |

* cited by examiner

*Primary Examiner*—David H. Bollinger
(74) *Attorney, Agent, or Firm*—Westman, Champlin & Kelly, P.A.

(57) ABSTRACT

A card printer has a card feed hopper assembly that will support stacks of two different size cards in hopper sections. The card feed hopper assembly is movable transversely of the printer to position the respective hopper sections to be aligned with a card feed path on the printer, and then positioned so that cards in the hopper section aligned with the card feed path will be driven into the printer. The hopper is lifted when it is moved transversely, and then lowered down to provide the card drive for cards in the hopper section that is aligned with the card feed path.

18 Claims, 7 Drawing Sheets

MULTIPLE CARD HOPPER FOR CARD PRINTER

CROSS REFERENCE TO RELATED APPLICATION

Reference is made to co-pending application Serial No. 09/604,459, filed on Jun. 27, 200 entitled CARD CLEANING ROLLER ASSEMBLY, and to co-pending application Serial No. 09/604,651, filed on Jun. 27, 2000 for CARD STACKER LIFTER AND EXCEPTION FEED, both of which are incorporated herein by reference.

BACKGROUND OF THE INVENTION

The present invention relates to a card hopper assembly for a card printer that includes more than one card hopper for holding stacks of cards to be printed so that more than one type of card can be stored and selectively fed into a printer under a programmed control. The card hoppers are slidably mounted on the printer frame and can be moved for aligning each of the hoppers with the card feed drive, and, when aligned, a card can be fed from the aligned hopper into the printer.

Printing on identification cards, which comprise plastic substrates made in different standard sizes and thicknesses has been known. In the past, the card feeders have used single card hoppers that will hold a stack of a selected size of card in a fixed position to be fed into the printer. The card feed mechanism will feed one card at a time from that stack. Hoppers that are adjustable in width so a different width cards can be fed have been provided but the stack in the hopper had to be removed, the width of the hopper adjusted, and the new stack of cards of different width put into place.

It may be necessary to print several cards of one type, and then print one or two cards of a different type, and then go back to the original cards. The cards in the two hoppers can be different widths, or thicknesses, for example. Also the differences in the cards can be different factors, such as magnetic strip, smart cards, proximity (rf) cards, or cards that had different pre-printed images.

In order to shift between different cards, it is time consuming to have to remove the stack of cards being processed from the hopper and then insert the stack of different cards. The ability to quickly change cards at the input of a printer is desired.

SUMMARY OF THE INVENTION

The present invention relates to a hopper assembly for feeding cards or substrates to a printer having more than one card hopper. Each of the hoppers may accommodate a different type card. A program control and drive will shift the hoppers from an initial position to feed a first card type, to another position to feed another card type under the control of a central program, which includes printer commands.

In one form of the present invention, a dual card hopper assembly is illustrated, but more than two hoppers can be used. The hopper assembly shown includes two individual card hoppers placed side by side, and each of the hoppers is adapted to hold a stack of cards, such as identification cards, forming printing substrates. The hopper assembly as shown is shiftable from side to side so that each of the hoppers can be placed in alignment with the printer card feed mechanism, and then moved to an operative position so that the cards in the stack of cards held in the hopper can be fed one at a time to the printer.

The hoppers are moved or shifted under a positive drive from a motor that is controlled by a central controller, or for cost purposes the printer could be manually controlled.

Sensors are provided on the printer frame to sense the position of the hoppers, and since the program control has memory that will indicate which way the motor that shifts the hopper assembly has moved, the position of the hopper assembly, and thus which hopper in the feed or home position is stored. At any time the controller stores information to indicate which hopper of the hopper assembly is at its home or card feeding position.

If the program for the printing sequence calls for a particular card type, that is different from the cards in the hopper aligned with the card feed, the hopper assembly is shifted to place the desired hopper, and its supported card stack in the proper position. To accomplish the shifting, the card hopper assembly is raised with a cam, and then is slid along support rails and guides to the desired position. Movement in the illustrative embodiment is in a lateral direction. The hopper outlet is moved to alignment with the card feed mechanism and the card printing path. The hopper assembly is lowered to engage the card feed with the end card in the card stack. Sensors may be used to determine if the desired card hopper is in its proper position, and also to sense when a card has been fed to the printer.

Manual operation of the hopper is also shown. The hopper can be raised using a motor drive and manually shifted, or manually raised and either manually or power shifted.

DETAILED DESCRIPTION OF THE ILLUSTRATIVE EMBODIMENTS

Figure 1:
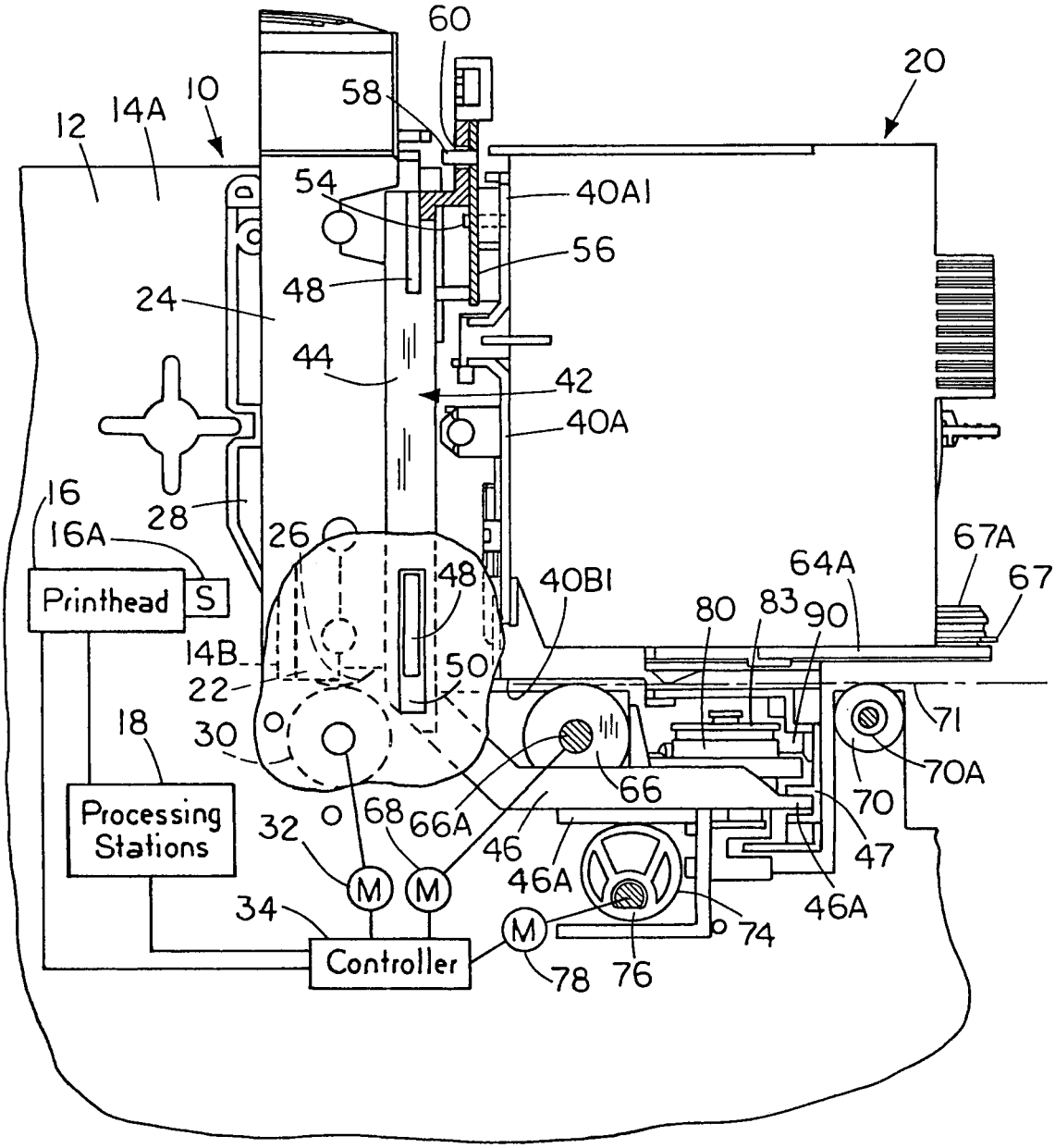
FIG. 1 is a side elevational view of a card feed hopper assembly made according to the present invention mounted on a card feed section of a fragmentarily illustrated printer frame.

In FIG. 1, a printer 10 is fragmentarily illustrated, with a side frame panel broken away. The printer 10 includes a printer housing or frame 12 that has side panels 14A and 14B (14B is shown only fragmentarily in FIG. 1) that are spaced apart, and which mount a printing assembly, including a printhead shown only schematically at 16 along with a platen and print ribbon, and further processing stations 18, such as a lamination station, a card inverter or stations for encoding magnetic strips or radio frequency (RF) components on the card, and any other desired processing station that performs a function or process on the card subsequent to printing. U.S. Pat. No. 5,941,522 illustrates a printer assembly with auxiliary processing stations. The cards to be printed are fed from a plurality of card hoppers forming a card hopper assembly indicated at 20, and by way of example, a card cleaning roller assembly 22 is positioned to receive cards from a stack in one hopper of the hopper assembly 20, and to move the individual cards toward the printing station 16. A sensor 16A is shown schematically and is used to signal when a card is being fed to the printer. The card cleaning roller assembly 22 includes a housing 24 that houses a cleaning roller 26, and which is mounted in suitable guides 28 on the frame side plates 14A and 14B. The roller 26 is a soft surface roller as shown in the previously mentioned application Ser. No. 09/604,459, filed on Jun. 27, 2000 and is not shown in detail. The cleaning roller does not have to be used with the present invention, but a clean surface on the card improves printing quality.

A card drive roller 30 is mounted on the frame side plates 14A and 14B, and is driven from a motor 32. The motor 32 and the printhead 16, and processing stations 18 and the operation and movements of the card hopper assembly 20 are controlled by a central controller 34. The drive roller 30 is a conventional drive roller that is positioned to receive cards from the hopper assembly 20, and to move the cards against the cleaning roller 26 and then move the card to the printhead. Additional drive rollers are used to move the card which has been fed to the printhead to the further processing stations.

Figure 2:
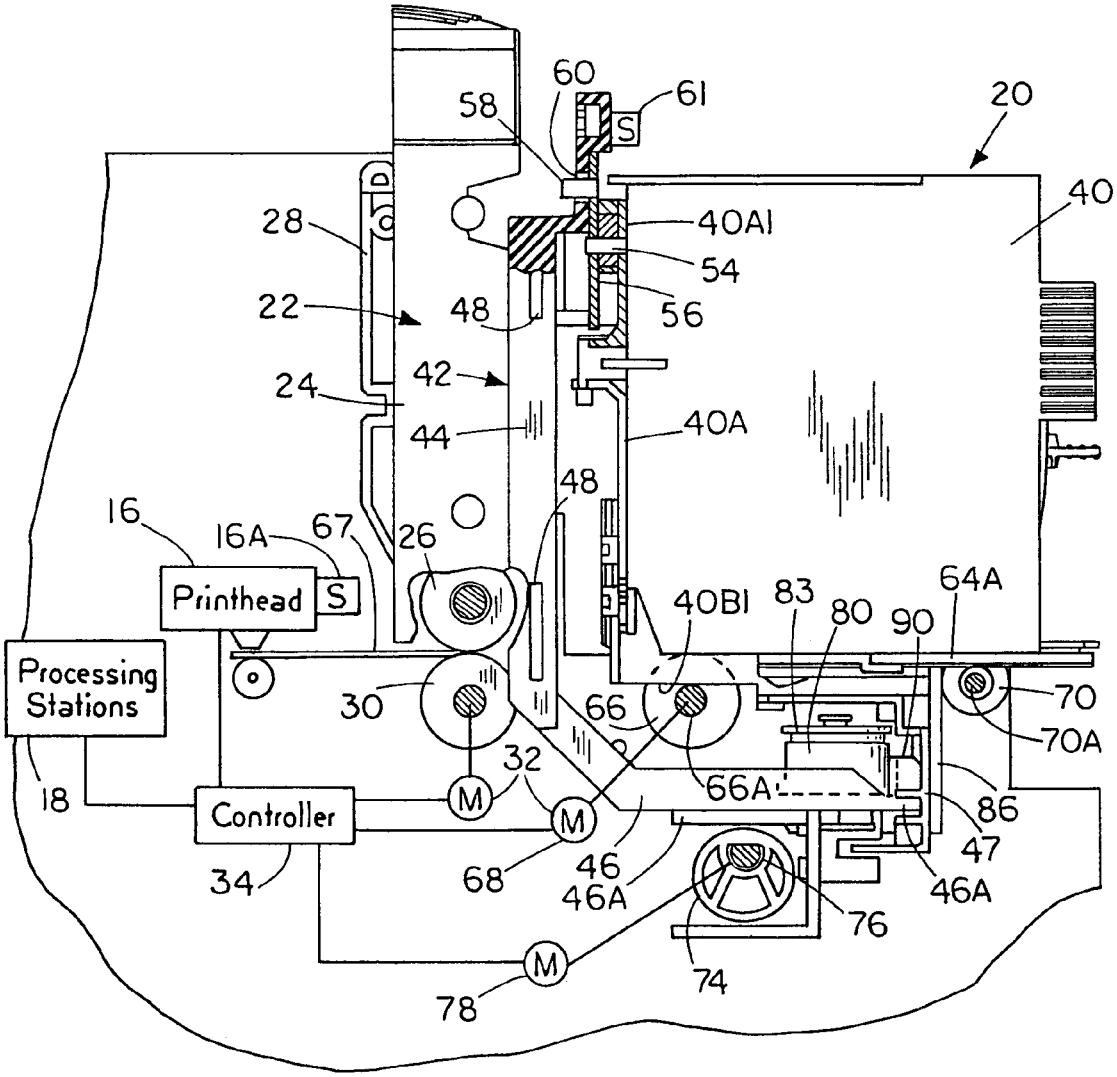
FIG. 2 is a side elevational view similar to FIG. 1 with the card hopper assembly in a lowered card feeding position.
Figure 3:
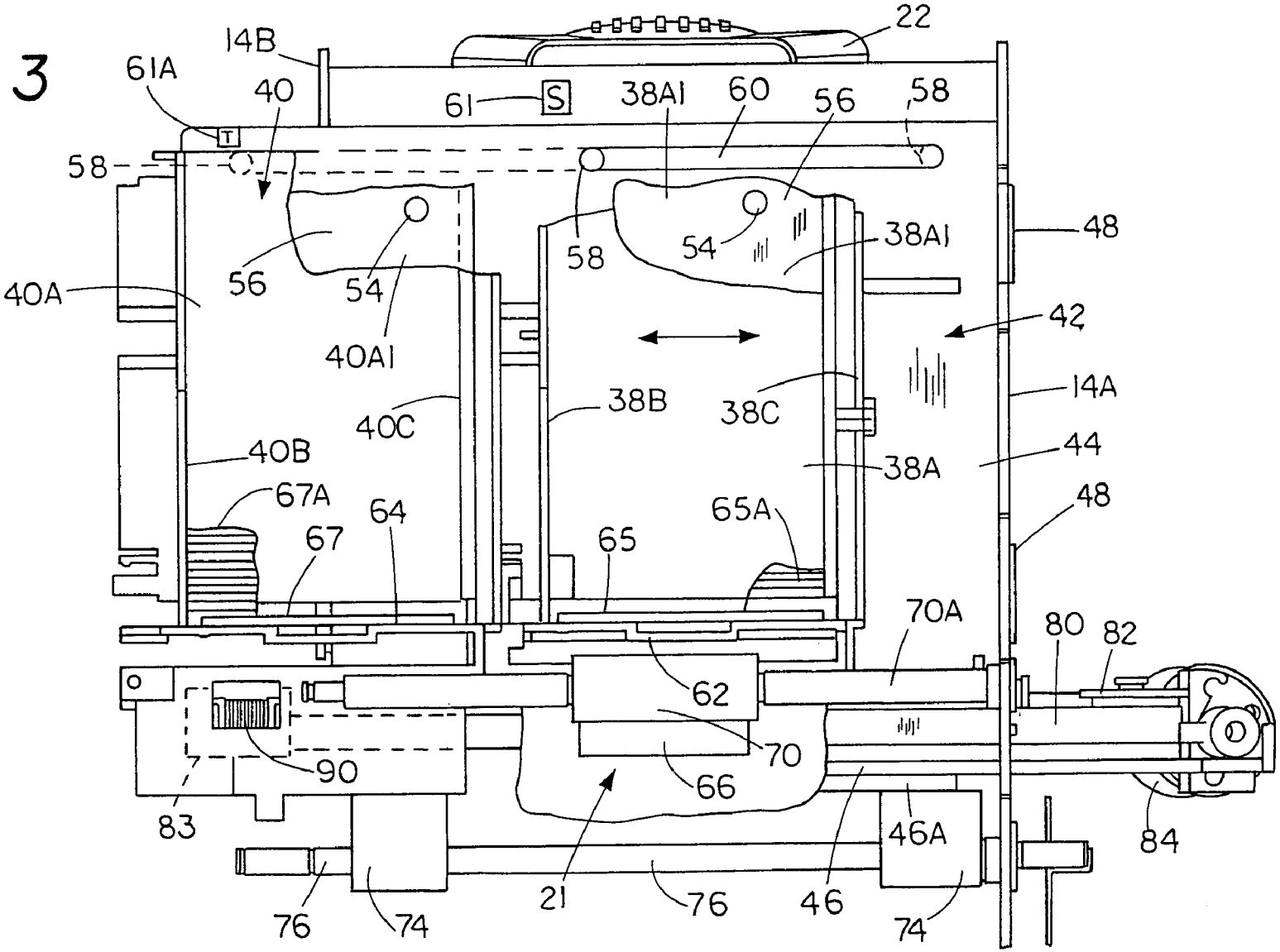
FIG. 3 is a rear elevational view of the card hopper assembly of FIG. 1 with a first card hopper aligned with a card feeding roller and with the hopper assembly in a raised position.

The card hopper assembly 20 provides two hoppers to hold stacks of cards, in the form shown, and includes a first card hopper 38, and a second card hopper 40 that are mounted onto a common lift plate 42 at the forward sides of the hoppers. The lift plate 42 is a support that is mounted to travel vertically up and down relative to the printer frame 12, and includes an upright wall 44, and a unitarily formed horizontal plate or tray portion 46 shown in FIGS. 1 and 2 in side view. The lift plate 42 is formed out of plastic, and includes guide ears or tabs 48, that are slidably mounted in provided slots 50 in the side plates 14A and 14B. In FIG. 1, the fragmentary showing of the side plate 14B illustrates one of the slots 50. The ears or tabs 48 guide vertical movement of the lift plate 42 and the hopper assembly 20, including hoppers 38 and 40, mounted on the wall 44. The hopper assembly 20 is lifted and carried by the lift plate when the hopper assembly is to be moved laterally for aligning one of the respective hoppers 38 and 40 with the printer card feed station 21. In FIG. 3 hopper 38 is aligned with feed station 21 and in FIG. 4 hopper 40 is aligned with feed station 21. The horizontal plate or tray 46 is parallel to cards supported in the hoppers. The plate of tray 46 also has a tab or slider 46A that is guided in a track 47 (see FIG. 1) for support and other supports or tracks can be provided, if desired. The track 47 is fixed relative to the printer frame 12.

Both of the hoppers 38 and 40 have forward walls shown at 38A and 40A in FIG. 3 for example, and these forward walls are used for mounting the hoppers onto the lift plate 42 at the top portion of the upright wall 44, so that the hoppers will move upwardly and downwardly with the lift plate and also be slidable laterally on the lift plate. The hoppers 38 and 40 are individually formed, and have side walls 38B and 38C, for the hopper 38, and 40B and 40C for the hopper 40. These walls 38B and 38C and 40B and 40C can be adjusted in width to provide for a different width cards, as is disclosed in copending application Ser. No. 09/604,214, filed on Jun. 27, 2000, and can have their card outlet or feed openings in the forward walls adjusted in the vertical size as well for different thicknesses of cards.

The front or forward walls 38A and 38B are made in two panels that slide relative to each other, and each of them has a first front panel shown at 38A1 and 40A1, which has suitable fasteners such as flush rivets or the like, one of which is shown in each of the panels 38A1 and 40A1 in FIG. 3 at 54 and these fasteners 54 secure the hopper assembly 20 to a unitary traveler plate 56 that is between the hopper and the upright wall 44 of the lift plate. The traveler plate 56 is supported so it will move from side to side on the lift plate 42, and is supported for up and down movement on the lift plate or frame 42. In order to support the travel plate 56 on the lift plate wall 44, a plurality of standoff pins 58 (see FIG. 1) are mounted on the plate 56, and project forwardly to fit into and slidably move in a slot 60 that extends transversely along, and which is formed in, wall 44 of the lift plate 42.

As shown, there are two standoff or slider pins 58 fixed on the traveler plate 56 and they are positioned in locations so that when hopper assembly 20 is moved to the position where hopper 38 is aligned with the printer card feed section or station 21, as will be explained, the standoff pins are shifted toward one end of the slot 60, and when the hopper assembly 20 is shifted to align the hopper 40 with the card feed station 21, the standoff pins 58 are shifted toward the other end of the slot 60.

The standoff pins 58 form the primary support for the hopper assembly 20 to permit its lateral and vertical movement.

The lift plate 42 is raised up and down before the hoppers are moved laterally, in order to provide for clearance for card support walls or bottom trays of the hoppers, including tray 62 at the bottom of the hopper 38, and tray 64 at the bottom of the hopper 40. These bottom trays 62 and 64 are made to support stacks 65A and 67A of cards 65 and 67 in the hoppers 38 and 40 and the bottom trays move with the hoppers. The trays 62 and 64 are formed to provide clearance relative to a card drive roller 66, which is mounted on a shaft 66A and driven by a motor 68, and which is rotatably mounted between the frame side plates 14A and 14B. The card feed roller 66 aligns with the card feed path of feed station 21 to the printhead 16 When the respective hopper is in its feeding position, the selected hopper will overlie drive roller 66. Additionally, there is a card stack support idler roller 70 that is mounted on a shaft 70A. The shaft 70A is rotatably mounted in the printer frame side plates 14A and 14B on suitable bearings, but is not power driven. The idler roller 70 is smaller diameter than the card feed roller 66 and is slightly longer in axial length. A plane lying along the upper side tangent lines of the rollers 66 and 70 forms a support plane represented in line 71 in FIG. 1 for the cards in the stack in the aligned hopper and the plane is on a tangent of the drive roller 30 on the output side of the hoppers. This plane is slightly inclined downwardly toward the hopper outlet opening to help in feeding the cards.

Figure 4:
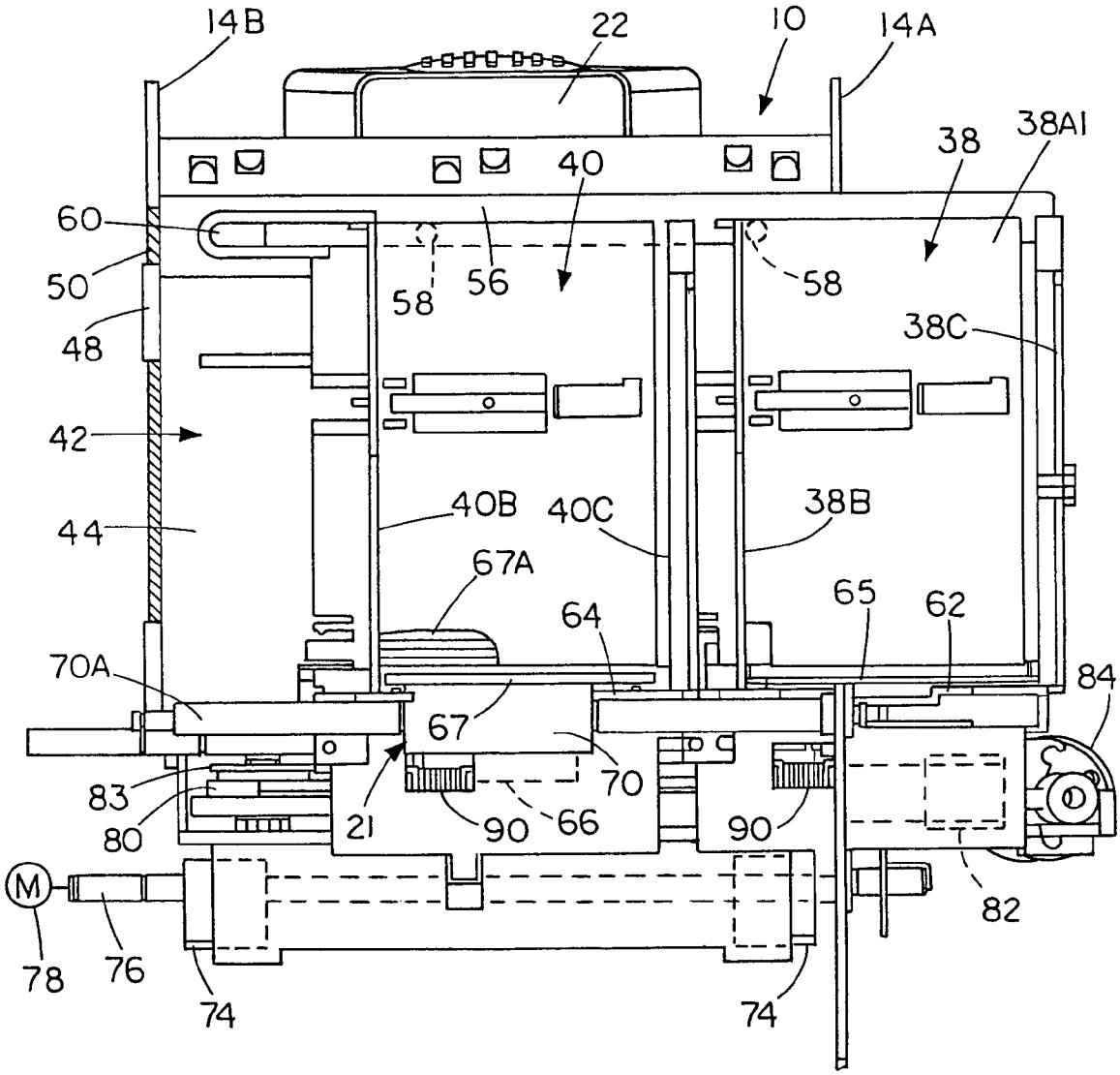
FIG. 4 is a rear view similar to FIG. 3, with the card hopper assembly in a second position with a second card hopper aligned with a card feed roller and lowered as shown in FIG. 2.

The bottom card support trays 62 and 64 are made to have cutout portions that will permit the hoppers and the trays to drop down so the trays are below the card support plane that is defined by the upper tangent lines of the rollers 66 and 70. When the hopper assembly 20 is in its working or lowered position, which is shown in FIGS. 2 and 4, the stack of cards in the hopper aligned with the card drive roller 66 will be supported on the drive roller 66 and idler roller 70. The lower card in the aligned stack will rest on rollers 66 and 70.

In order to raise the card hopper assembly 20, so that it can be shifted laterally from side to side, and so that it clears the rollers 66 and 70, the lift plate 42 is raised and lowered through the use of a lift member or cam 74 that is mounted onto a cam shaft 76, which in turn is driven with a controllable, reversible motor 78. The cam 74 is below and acts against the tray portion 46 of the lift plate 42. The cam 74 (there are two cam sections spaced along shaft 76) will ride against a portion 46A of lift tray 46 shown at 46A. The cam 74 has the two sections, as shown in FIG. 3 and FIG. 4. The cam 74 is shown in its hopper assembly raised position in FIGS. 1 and 3, where it has raised the lift plate 42 to a position where the bottom card trays 62 and 64 of the card hoppers are above the rollers 66 and 70. This means that the hopper assembly 20 including the hoppers 38 and 40 can be moved laterally (side to side) without interfering with the rollers 66 and 70. Gravity urges the hopper assembly and lift plate 42 downwardly. A light spring could also be used to provide a downward load.

Figure 6:
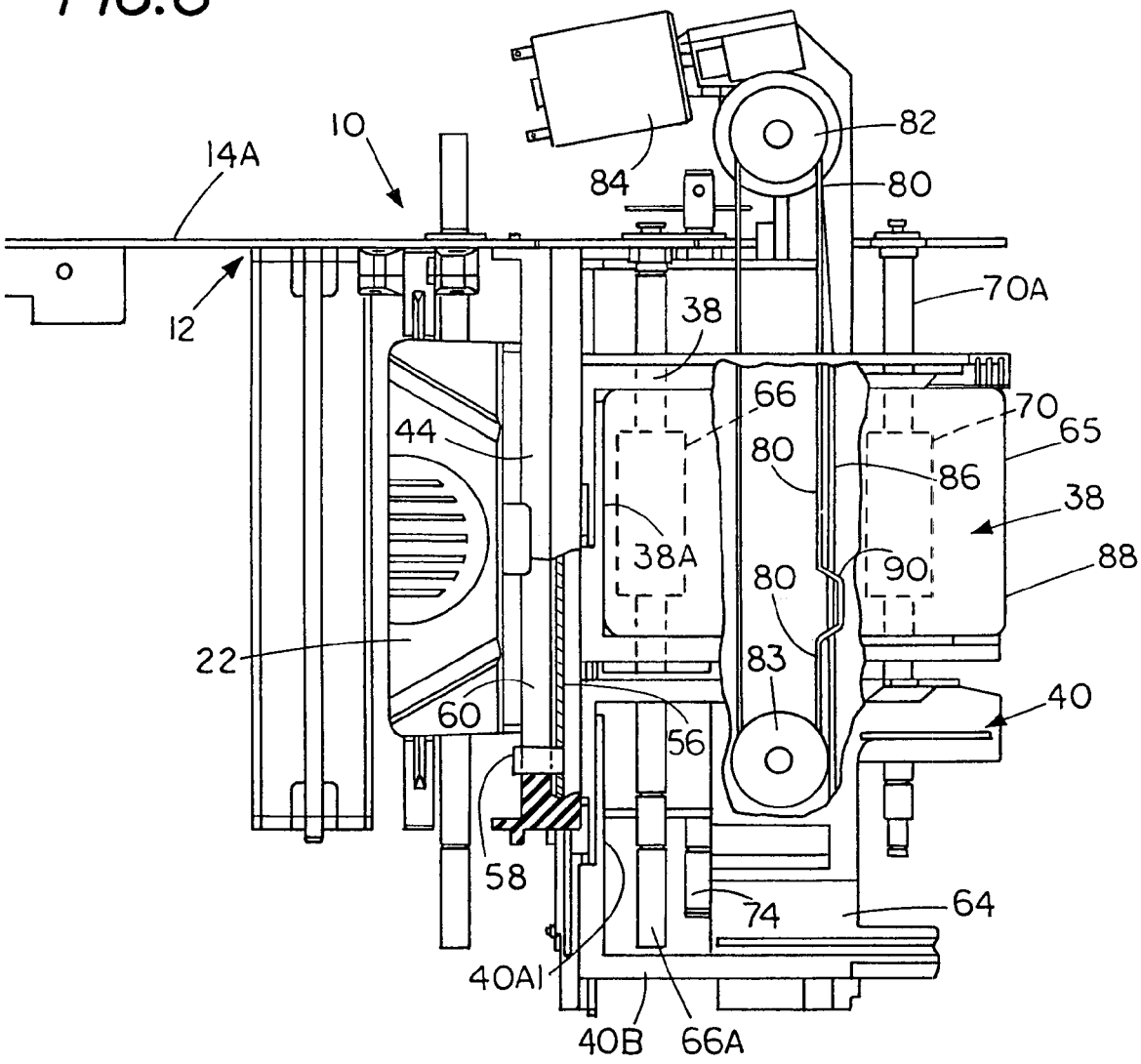
FIG. 6 is a top plan view similar to FIG. 5 with the hopper assembly in a second position, corresponding to the position shown in FIG. 3.

The lateral movement drive for the hopper assembly, which moves the hopper assembly laterally along the lift plate 42 is provided with a drive belt 80, which is an endless belt mounted onto a drive pulley 82 at one side of the printer and on idler pulley 83 at an opposite side of the printer. The belt 80 extends transversely of the printer and hopper assembly. The belt 80 is driven by a pulley 82 which in turn is driven by a motor and gear reducer unit 84 on one side of the printer, as can be seen in FIGS. 3 and 6. The belt 80 passes underneath the hoppers 38 and 40. There is a depending wall section 86 that is fixed to the hoppers and can form part of the bottom trays 64 and 62 of the hoppers near an open card hopper inlet end indicated generally at 88 for the hopper assembly 20. The wall section 86 has a belt securing member 90, which permits the belt 80 to loop in and out around the securing member 90 as shown in FIG. 6, so that the hopper assembly 20 will move laterally when the belt 80 is driven through the motor and gear reducer section 84. Other securing devices can be used, such as a rivet.

The motor and gear reducer set 84 is controlled from the central controller 34, so that the shifting of the hopper is done under a programmed control.

When the cam 74 is in its hopper raised position, it lifts the lift plate 42 upwardly. The lift plate 42 is guided by guide ears or tabs 48 sliding in slots 50 of the printer side plates. When the bottom trays 62 and 64 are lifted clear the rollers 66 and 70 and other supports or guides that may be used, the motor 84 can be driven to shift the hopper assembly between the position shown in FIG. 3 where the hopper 38 is in the card feed location and the position shown in FIG. 4, where the hopper 40 is aligned with feed station 21 and the rollers 66 and 70, and thus in the card feed position. A sensor 61 is shown schematically to sense a target (61A in FIG. 3) on the plate 56 to provide a signal indicating which hopper is in the feed station 21. A separate target is used for each hopper.

Figure 5:
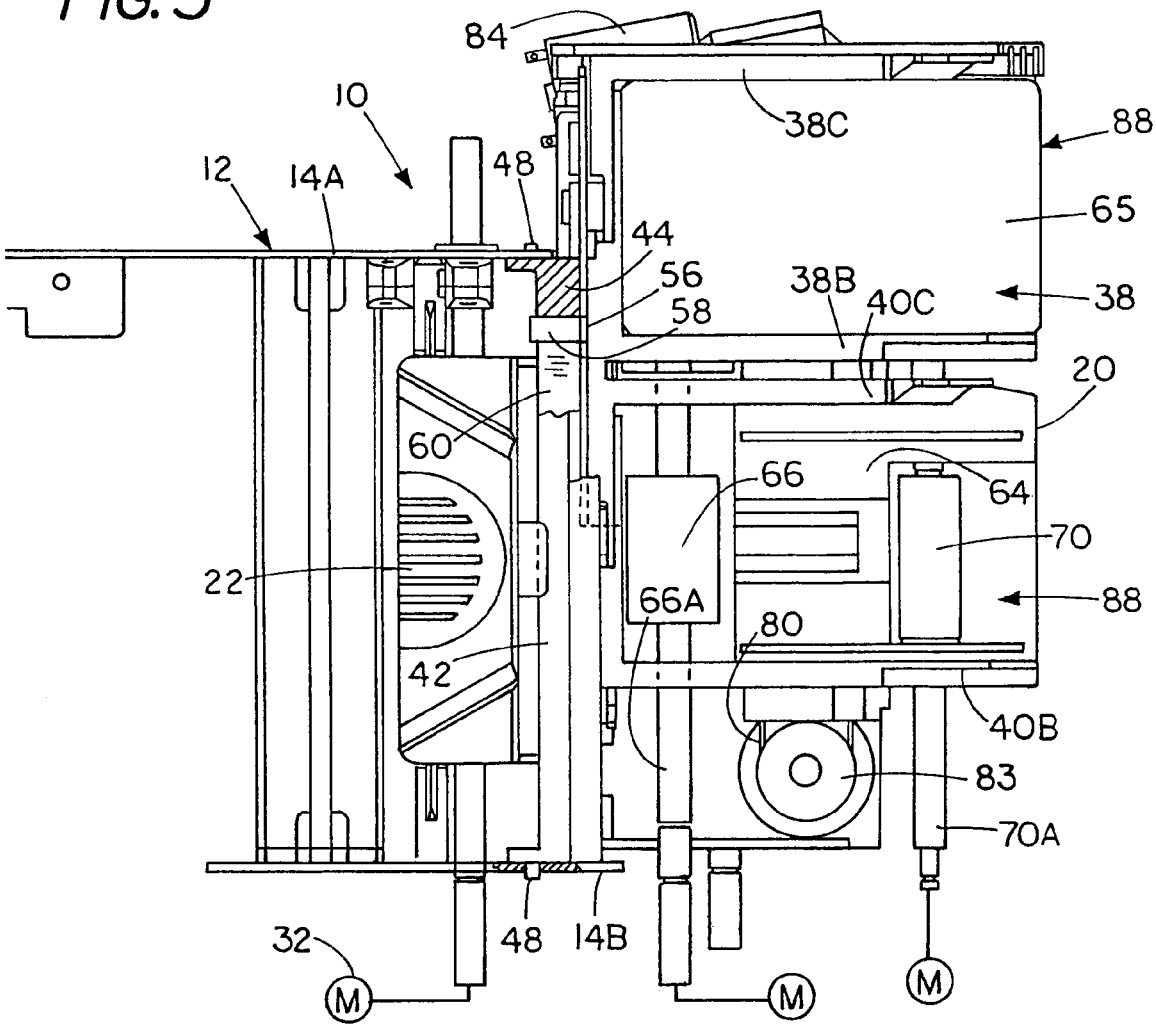
FIG. 5 is a top plan view of the hopper assembly of FIG. 4.

In FIG. 5, the tray 64 is shown in plan view. The tray has cutouts or relief areas so that the roller 70 will pass upwardly through the plane of the tray. The roller 66 is to the rear of hopper outlet or feed opening end of the tray 64, so that when the hopper assembly is lowered, as shown in FIG. 4, the trays are below the level of the plane 71 lying along the tangent lines on the tops of the rollers 66 and 70. The card stack in the hopper aligned with the rollers 66 and 70 rest on the rollers and the bottom card will be driven or fed when roller 66 is driven.

With the hopper assembly loaded with cards, when the motor 84 is driven, the standoff members 58 will slide in the slot 60 of wall 44 of the lift plate 42. The belt 80 will move the hopper assembly when the hopper assembly is in the proper position so that one or the other of the hoppers 38 and 40 is in the feed station 21 over the rollers 66 and 70 according to the control program of controller 34. The cam 74 is moved to its lowered position by drive motor 78 as shown in FIG. 2. The hopper assembly 20 will drop down, so that the card stack, such as the card stack 65A will be supported on the rollers 66 and 70, and by driving the roller 66 with its motor 68, the lower card 65 will be fed over to the drive roller 30, and can be cleaned with the cleaning roller 26 and then fed to the printhead 16 for printing.

When cards in the other hopper 40 are to be printed, the cam 74 is driven to its raised position lifting left plate 42 and hopper assembly 20. Then the motor and gear set 84 can be started and the hopper assembly 20 shifted so that the hopper 40 is in position to feed a card.

The card hoppers are bounded by side walls 38B, 38C, and 40B and 40C, as stated. These side walls have lower edges, and as shown typically in FIG. 2, where the side wall 40B is illustrated. The side wall 40B has lower edges 40B1 that will ride on the shaft 66A of roller 66, at the forward edge. each of the side walls 38B, 38C, 40B, and 40C have these lower edges that ride on the shaft 66A, to provide a proper positioning of the card hopper when the hoppers are lowered. Additionally, the trays 62 and 64 have lug portions as shown at 64A in FIG. 2 that ride on the shaft 70. The plastic hopper side walls and plastic bottom trays thus provide guides for proper positioning of the card hopper and the card hopper outlet for alignment with the feed mechanism. The outlet location is established by the surfaces of the shafts for the rollers 66 and 70.

Figure 7:
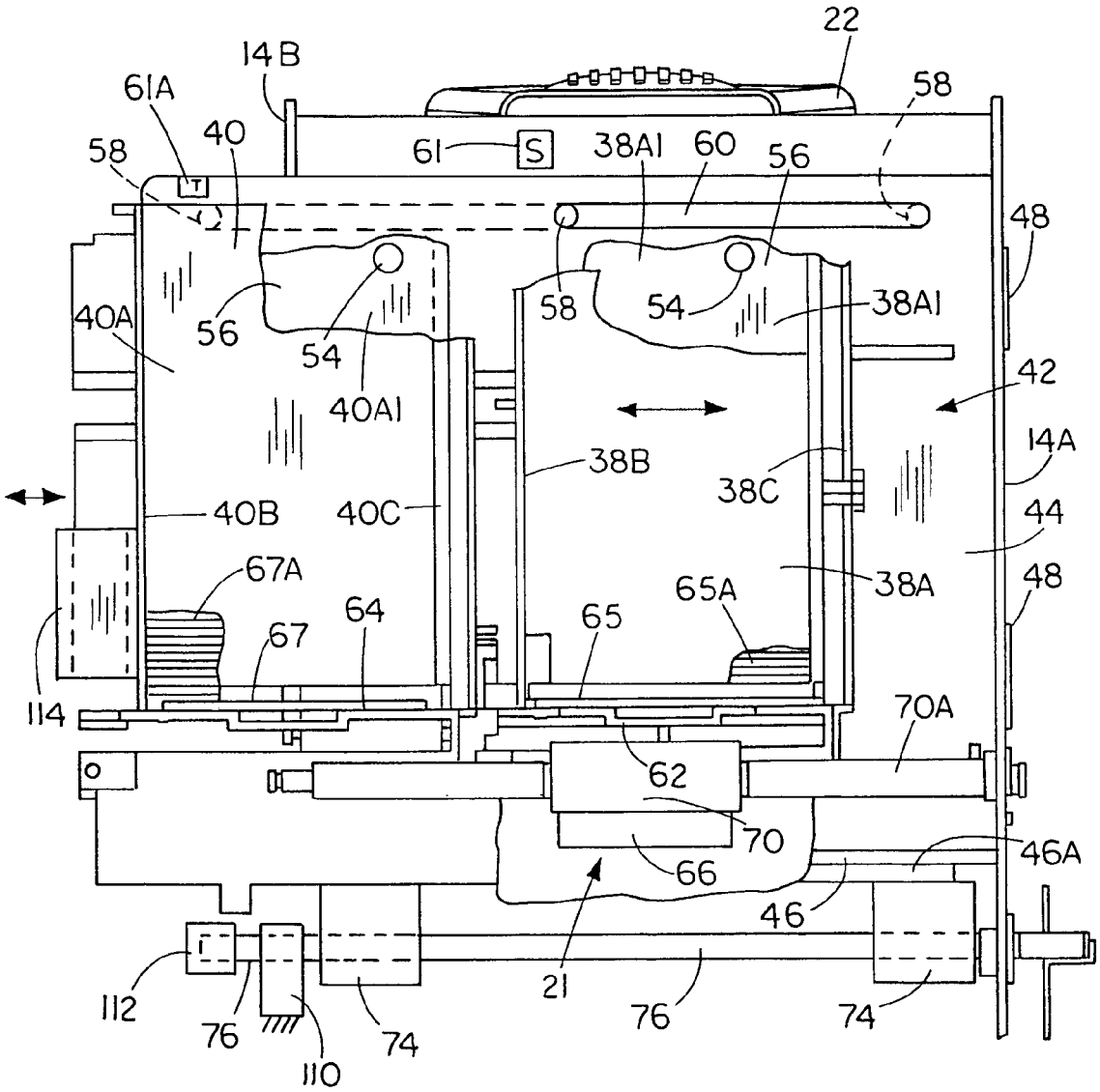
FIG. 7 is a view similar to FIG. 3 with manual operation of the hopper.

In FIG. 7, a view generally the same as FIG. 3 is illustrated, and the same numbering is used, except that the drive motor for the cam is replaced with a manual knob or lever, and the motor and belt arrangement for moving the hopper assembly laterally is removed, and a manual lever or actuator is illustrated. That means that the cams can be operated manually so the shaft 76 is manually rotated to lift or lower the hopper assembly, and then the hopper can be shifted laterally manually.

Of course, the lateral shifting of the hopper can be manually done with a motor driven lift member or cam that would be automatically controlled by the central controller. In FIG. 7, the cam shaft 76 is shown supported on a bearing 110, and a manual knob 112 is provided at the end of the shaft 76, and is accessible under the support mechanism for the hoppers. The manual knob 112 can be rotated to a position as shown in FIG. 7 with the cams in a position raising the hopper assembly, and rotated manually to lower the hopper when the hopper is in the desired location.

The hopper assembly has a schematically shown hand lever or plate 114 that is merely attached to one of the side walls of the hopper, as shown attached to the side wall 40B. This lever or plate 114 can be manually grasped and the hoppers can be slid laterally from side to side as supported on the pins 58, under manual control, when the motor and belt drive that has previously been shown is eliminated.

It should be noted that the cams 74 can be operated with the motor as in the first forms of the invention and then the hopper assembly slid from side to side manually after the hopper assembly has been raised by the cams, or both the cam shaft 76 and the hoppers can be manually operated, or if desired, the cam shaft can be manually operated and the hoppers moved under power from the drive motor and belt arrangement shown.

All of the other functions of the printer, and the operation of the card sensing unit and the like would remain the same.

Again, the hoppers can be adjustable to provide for different width cards, and the card outlet openings from the hoppers can be adjusted for different thicknesses. Thus, the two types of cards could be cards that have different widths, or different thicknesses, or both. Also the cards in the hoppers could differ in other respects such as the presence of different auxiliary components such as magnetic strips, smart cards, proximity cards or cards that have different pre-printed images.

The hopper assembly can have more than two hoppers, as desired, as long as the lateral extension of the hoppers does not become too great.

The control functions command the movements of the hoppers, and the raising and lowerings of the hoppers. Alternatively one or both mounts of the hoper can be manually controlled.

Although the present invention has been described with reference to preferred embodiments, workers skilled in the art will recognize that changes may be made in form and detail without departing from the spirit and scope of the invention.

What is claimed is:

1. A card feed hopper assembly for feeding cards from a selected one of a plurality of hopper sections in the hopper assembly into a printer, said hopper assembly including at least first and second hopper sections positioned adjacent each other and movable to positions wherein one of the hopper sections is in a first reference position, the hopper assembly including a lift plate, and the hopper sections being slidable on said lift plate, and a lift member to move said lift plate to provide clearance for the hopper sections to slidably move on the lift plate to selectively place each hopper section in the first reference position.

2. The card feed hopper assembly of claim 1, wherein said at least first and second hopper sections each have a tray at the bottom thereof forming a card support, said tray of each of the hopper section lifting a card stack in the hopper sections as the card hoppers are lifted.

3. The card feed hopper assembly of claim 1, wherein the hopper sections are positioned side by side.

4. The card feed hopper assembly of claim 1, wherein said lift plate has an upright portion and a generally horizontal portion, the horizontal portion being substantially parallel to cards in a card stack in each hopper, the lift member to move the lift plate comprising a cam, the lift plate being engageable with the cam, said cam being rotatable to raise and lower the lift plate and the hopper sections.

5. The card feed hopper assembly of claim 4, wherein said cam is rotatably mounted on a printer frame, and is driven by a separate motor controlled by said control to lift and lower the lift plate and the card feed hopper assembly.

6. The card feed hopper assembly of claim 4, wherein said cam is rotatably mounted on a printer frame, and a manual knob to rotate the cam to lift and lower the lift plate and the card feed hopper assembly.

7. The card feed hopper of claim 1 and a power drive connected to the hopper to move the hopper section selectively to the reference position.

8. The card feed hopper assembly of claim 4, wherein the card feed hopper assembly has a pair of slider pins on a wall thereof, the slider pins extending into a slide track on the upright portion of the lift plate.

9. The card feed hopper assembly of claim 5, in a combination with a printer having a frame comprising side plates, the lift plate having tabs that slidably mount in the side plates for movement between lifted and lowered positions of the card feed hopper assembly.

10. The card feed hopper assembly of claim 5, wherein said card feed hopper assembly has wall portions which extend downwardly from a card support plane, a card feed comprising a pair of rollers that support cards in the one hopper in the first reference position, the rollers being mounted on shafts that extend axially beyond the rollers, said wall portions engaging the shaft on at least one of the rollers when the card feed hopper assembly is in a lowered position.

11. The card feed hopper assembly of claim 10, wherein said rollers include an idler roller having a shaft and positioned at an open end portion of the card feed hopper sections, said idler roller supporting the stack of cards when the card feed hopper assembly is in a lowered position, and a bottom tray for supporting the card stack when the card feed hopper assembly is in a raised position, the tray having surface portions that will ride on a shaft for said idler roller when the card feed hopper assembly is lowered, the idler roller extending above the tray when the card feed hopper assembly is lowered.

12. The card feed hopper assembly of claim 1, and a drive connected to the card feed hopper assembly for moving the hopper sections between the first reference position and second positions comprising an endless belt mounted below the card feed hopper assembly, said belt being drivably connected to said card feed hopper assembly at a location such that when the belt is driven in a first direction, the card feed hopper assembly will be moved to position the first hopper section in the first reference position comprising a card feed position, and such that when the belt is moved in an opposite direction, the card feed hopper assembly will be shifted to place the second card hopper section aligned with the card feed position.

13. A hopper assembly for a printer comprising a plurality of hopper sections, each of said sections being of size to hold a substrate to be moved into a printer, the hopper assembly being mounted on a printer frame, and the hopper assembly including a support slidably mounted for transverse movement relative to the printer frame, and a lift mechanism to lift the hopper assembly to provide clearance for moving the support and hopper assembly transversely from a first position to a second position, wherein the hopper sections are selectively aligned with a printing path on the printer in one of the first and second positions.

14. The hopper of claim 13 and a power drive to drive the support and hopper assembly transversely between the first and second positions.

15. The hopper of claim 13, wherein said hopper assembly is mounted onto a lift plate supported on the printer frame, guide members on the hopper, a slot on the printer frame for receiving said guide members, and a drive between the hopper assembly and the lift plate for laterally moving the hopper relative to the lift plate between its first and second positions.

16. The hopper of claim 15, wherein said lift plate includes a cam follower section, a cam rotatably mounted on a printer frame for engaging the cam follower section, said cam being rotatable to lift the lift plate to a first lifted position, and to lower said lift plate to a second drive position wherein cards in one of the hoppers engage a card feed drive.

17. The hopper of claim 16 and a motor connected to the cam for rotating the cam.

18. A method of selectively feeding at least two different cards to a card printer having a card feed station comprising providing a plurality of card hoppers adjacent each other and movably mounted on the printer, lifting the card hoppers, selectively moving one of the card hoppers into alignment with the card feed station, and lowering the one card hopper in alignment with the card feed station to permit feeding cards in the one hopper to the printer.

* * * * *